United States Patent [19]

Dunkerley et al.

[11] 4,023,985

[45] May 17, 1977

[54] STEEL ABRASIVES AND METHOD FOR PRODUCING SAME

[75] Inventors: Fred J. Dunkerley, Broomall, Pa.; Albert J. Gaudino, Parma; Robert P. Vilyus, Maple Heights, both of Ohio

[73] Assignee: Cleveland Metal Abrasive, Inc., Cleveland, Ohio

[22] Filed: Sept. 29, 1975

[21] Appl. No.: 617,362

[52] U.S. Cl. ..... 148/3; 75/.5 BA; 75/.5 C; 148/36

[51] Int. Cl.[2] ..... B22D 23/08

[58] Field of Search ..... 75/.5 BA, .5 C; 148/3, 148/35, 36; 264/11, 12

[56] References Cited

UNITED STATES PATENTS

| | | | |
|---|---|---|---|
| 224,858 | 2/1880 | Winterlich et al. | 75/.5 BA |
| 2,863,790 | 12/1958 | Chen | 148/3 |
| 2,867,554 | 1/1959 | Wilson et al. | 148/3 |
| 2,974,031 | 3/1961 | Wilson et al. | 75/.5 BA |
| 3,649,370 | 3/1972 | Dorn et al. | 148/3 |

*Primary Examiner*—W. Stallard
*Attorney, Agent, or Firm*—John H. Mulholland

[57] ABSTRACT

Disclosed is a method of producing a versatile as-cast steel shot having a substantially fully martensitic structure and corresponding full hardness which permits eliminating intermediate steps of heat treating to harden and subsequent drying in producing steel shot having a tempered martensitic structure or in producing steel grit.

The method includes steps of charging, melting, refining, and pouring. The pouring step is accomplished by directing a stream of the refined molten steel through a stream of water under pressure and into a fluid quenching bath. The refined steel comprises: carbon in about the range of from 0.6 to 1.20 per cent by weight; manganese in about the range of from 0.50 to 2.26 per cent by weight; silicon in about the range of from 0.3 to 1.80 per cent by weight; sulphur in about the range of from 0.0 to 0.1 per cent by weight; phosphorous in about the range of from 0.0 to 0.1 per cent by weight; boron in about the range of from 0.0 to 0.01 per cent by weight; with the remainder of the metal being substantially all iron and trace elements and impurities commonly found therein. The boron, when present, is the result of an alloy-adding step which includes the addition of ferro-boron to the melted metal.

The method yields an as-cast shot hardness in the full hard Rockwell C (Rc) range of 65+ to 67+ in a significantly increased per cent of heats over what is normal in as-cast steel shot having comparable carbon per cent by weight and having generally the same chemistry. The control of carbon in the preferred range and/or the use of boron as an alloying element to produce substantially fully martensitic or full hard as-cast shot permits elimination of both the hardening furnace and drying operation following hardening. The as-cast product goes directly into a tempering operation to make tempered martensitic shot or to a crushing operation to make grit.

9 Claims, 1 Drawing Figure

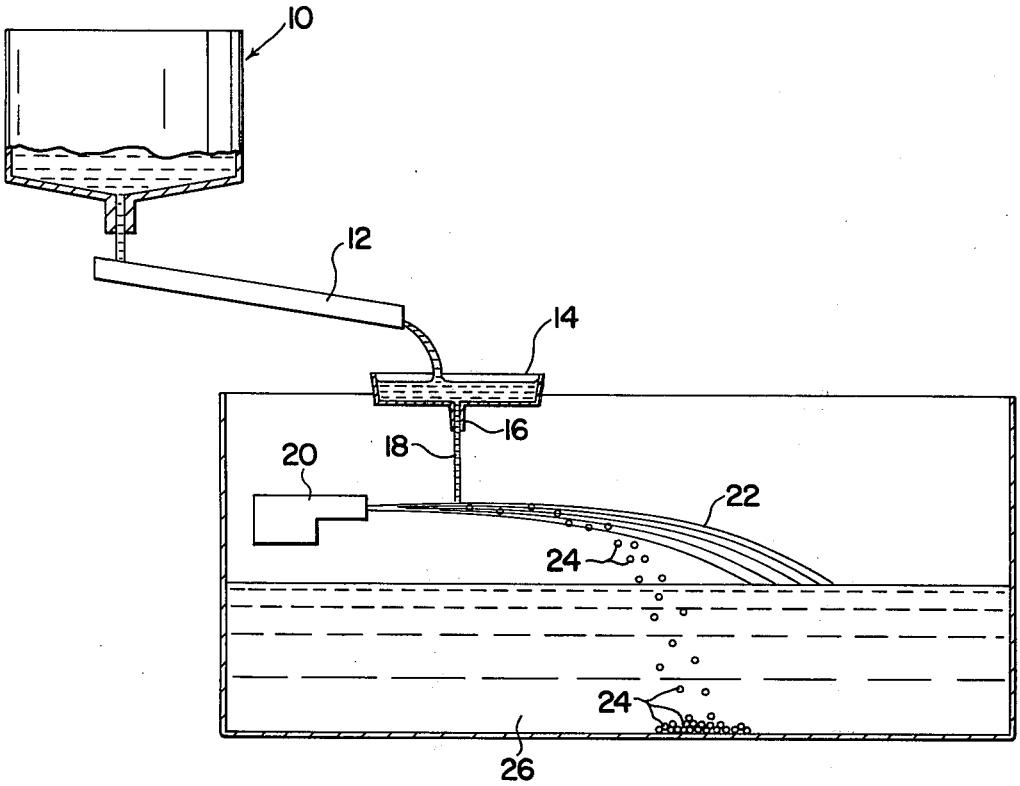
10
12
14
16
18
20
22
24
24
26

STEEL ABRASIVES AND METHOD FOR PRODUCING SAME

BACKGROUND OF THE INVENTION

The manufacture of steel shot and grit heretofore has been basically standard within the steel abrasives industry and steel shot and grit is sold subject to either the Society of Automotive Engineers (SAE) standards or the Steel Founders Society of America (SFSA) standards. The SFSA specification for cast steel abrasives carries the designation 20T-66 and is widely used. It sets forth technical requirements, particularly with regard to chemistry, microstructure, appearance and hardness. The process of manufacturing typically includes steps of: charging, melting, refining and pouring, with the pouring step being accomplished by directing the melted and refined molten steel through a stream of water under pressure and into a water quenching bath. The as-cast shot then, after being dried, is taken to a hardening furnace which is typically a continuously rotating retort having a series of gas burners controlling its temperature. After going into a quenching pit from the hardening furnace and again going through a drying operation, both of which consume natural gas, the hardened shot is subjected to a tempering operation to make tempered martensitic shot or to a crushing operation to make grit. The tempered martensitic shot ends up with a preferred hardness on the Rc Scale of from about 40 to 50.

As a direct result of the recent "energy crisis" and resulting reduction of allocations of natural gas to industrial users, attempts to determine ways to minimize consumption of natural gas in the steel abrasives manufacturing processes led to experimentation with close carbon control and boron additions. The fact that boron additions in steel generally could improve hardenability was known and a typical discussion of this phenomena was published in "Foote Notes on steel, No. 2", Information of interest to the steel industry, Published by Foote Mineral Company, Exton, Pa. 19341. Another discussion can be found in the Metals Handbook, Vol. 1, 8th Ed. (ASM); in particular, the section on "Selection for Hardenability", beginning at page 189 and FIGS. 1, 6(b) and 13 of that section. Metallurgists, however, have generally thought that the addition of boron has the effect of making coarse grain size and it was not known whether this would be controllable in steel abrasives. Other problems which could have occurred by adding boron to steel shot heats relate to the SFSA 20T-66 shot internal and external appearance standards which limit the permissible amount of voids, shrinkage and cracks. The invention is the culmination of work which included many heats with various carbon percents by weight and various addition of levels of ferro-boron, including boron free heats. Typically, the heats were 7 tons in magnitude and were made in a 9 foot "Whiting" 3500 KVA direct arc electric furnace under the same conditions.

BRIEF DESCRIPTION OF THE INVENTION

The invention relates to a method for producing a versatile as-cast steel shot having a substantially fully martensitic structure and corresponding full hardness which permits eliminating an intermediate step of heat treating to harden in producing steel shot having a tempered martensitic structure or in producing steel grit. The normal intermediate steps of heat treating to harden and subsequent drying are natural gas consuming operations in separate furnaces which by practicing the instant invention are eliminated. The method produces as-cast steel shot with a substantially fully martensitic structure and a corresponding full hardness, that is, a hardness over Rc 65. Also, in the higher hardness range, namely from Rc 62 on up, an increase in hardness of approximately Rc two points has been noted at a given carbon percent by weight when boron is present in about the range of from 0.0001 to 0.01 percent by weight.

Steel grit is made by crushing shot which preferably has a hardness closer to Rc 67 than to Rc 65. The approximate two hardness points picked up by the addition of boron to the steel has greatly simplified grit manufacturing in that even for shot produced for use as a raw material in this operation, the hardening and drying furnace can be eliminated and the as-cast shot efficiently utilized in the crushing operation.

The method for accomplishing these desirable ends and for producing as-cast steel shot having a substantially fully martensitic structure and corresponding full hardness includes steps of charging, melting, refining and pouring. The pouring step is accomplished by directing a stream of the refined molten steel through a stream of fluid under pressure and into a fluid quenching bath. The steel shot produced has a chemical composition comprising: carbon in about the range of from 0.6 to 1.20 percent by weight; manganese in about the range of from 0.50 to 2.26 percent by weight; silicon in about the range of from 0.3 to 1.80 percent by weight; sulphur in about the range of from 0.0 to 0.1 percent by weight; phosphorous in about the range of from 0.0 to 0.1 percent by weight; boron in about the range of from 0.0 to 0.01 percent by weight with the remainder substantially all iron and trace elements and impurities commonly found therein. The boron, when present, is the result of an alloy-adding step which includes the addition of ferro-boron to the melted metal.

The ferro-boron alloying material nominally has 18 percent by weight boron and 82 percent by weight iron and impurities.

BRIEF DESCRIPTION OF THE DRAWINGS

FIG. 1 is a schematic view of the equipment used in the method steps of melting, refining and pouring.

DETAILED DESCRIPTION OF THE INVENTION

The novel method of the invention is for the production of a versatile as-cast steel shot having a substantially fully martensitic structure and corresponding full hardness which permits eliminating an intermediate step of heat treating to harden in producing steel shot having a tempered martensitic structure or in producing steel grit. The term "substantially fully martensitic structure" means one which is 94 to 100 percent martensite with acceptable quantities of bainite as set forth in SFSA Standard 20T-66. The term "full hardness" means hardness of 65 or above on the Rockwell C, (Rc), Scale. The term "hardness" means the resistance of the material to plastic deformation by indentation. All hardness values have been measured by a "Tukon" hardness machine using a testing load of 1000 grams (1Kg.) and a 136° pyramid diamond indenter. The term "hardenability" means the property that determines the depths and distribution of hardness that may be induced by quenching. It will be seen that in the novel method of making versatile as-cast shot, boron improves hardenability particularly in carbon range above the preferred range of 0.68 to 1.06 percent by weight. Moreover, in the range above a hardness of Rc 62, boron improves the hardness, per se, by about two points Rc over corresponding as-cast steel shot without the boron added to it. This invention, accordingly, permits the manufacture of steel shot and grit according to industry standards without the consumption of gas in intermediate shot hardening and drying operations which have been heretofore required. Because of the improvement of the hardness, per se, in the higher hardness range, the method permits the production of a shot sufficiently hard without a separate hardening and drying operation, to be successfully crushed to form steel grit which meets industry standards.

In the many boron containing heats and many boron free heats made during the development of the invention, it was discovered that the boron containing heats ranged in carbon from about 1.45 to 0.68 percent by weight and the hardness of these heats ranged from about 56.8 to 67.2 Rc. In these heats the boron ranged from 0.003 to 0.010 percent by weight. When the samples were taken 2 minutes after addition, the boron range was 0.0003 to 0.009, and when the samples were taken up to 25 minutes after addition, the boron range was 0.0008 to 0.010. The boron alloying procedure of the invention yielded an as-cast shot hardness in the full hard Rc 65+ to 67+ range, in approximately 95 percent of the heats in which the steel chemistry was in the preferred range of 0.068 to 1.06 percent carbon. The lower as-cast hardness examples in heats with boron resulted from abnormally high carbon or high water pressure in the casting and the pouring process.

It was found that boron probably has a limited solubility in steel at 0.0012 and additions over this amount are not necessary. However, additions have successfully been recovered in lab samples in amounts up to 0.010 on samples taken up to 25 minutes after the addition. One of the important and surprising things is that the grain size has not shown a tendency to coarseness by the addition of the boron, but remains in the range of from 7 on up. In addition, it has been noted that at high hardness levels, boron addition affects hardness as well as hardenability by as much as two points on the Rc Scale. By the term "high hardness level" is meant from Rc 62 on up. Moreover, a second hardening effect, as a result of the boron addition, can be obtained by the tempering operation and this effect has resulted in an increase in the tempered hardness from as low as Rc 38 to 40 to as high as Rc 48 to 50.

The reason this is important is that the characteristics required of cast steel shot, i.e. hardness, microstructure, chemical analysis, appearance (external and internal) and breakdown life are all, at least to some degree, dependent upon hardenability and hardness. With proper control of the carbon, particularly within the preferred range of about 0.68 to 1.06 percent by weight, and the water pressure during pouring, it was found that boron steel shot can be successfully maintained within the specifications without a hardening furnace operation such that a substantially fully martensitic structure, namely one from Rc 65+ to 67+ can be obtained with 95 percent surety. This conclusion is based upon many 7 ton heats made in a "Whiting" 3500 KVA 9 foot electric arc furnace.

Table I illustrates the heats in which boron was added and shows those heats in which the approximate maximum and minimum carbon percents by weight were present, as well as significant typical heats in the carbon range therebetween.

TABLE T

| BORON HEATS (Elements In Percents By Weight) | | | | | | |
|---|---|---|---|---|---|---|
| | | | | | B | |
| C | Mn | Si | S | Rc | 2 min | up to 25 min |
| 1.45 | 0.73 | 1.23 | 0.066 | 58.9 | 0.0007 | 0.005 |
| 1.14 | 0.68 | 1.82 | 0.067 | 66.5 | 0.0005 | 0.002 |
| 1.05 | 0.91 | 0.99 | 0.037 | 67.2 | 0.001 | 0.003 |
| 1.03 | 0.79 | 0.78 | 0.049 | 66.6 | 0.009 | 0.010 |
| 0.98 | 0.63 | 1.31 | 0.070 | 66.2 | 0.0003 | 0.003 |
| 0.68 | 0.54 | 1.36 | 0.054 | 66.5 | 0.001 | 0.001 |

Table II illustrates the boron-free heats at the approximate maximum and minimum carbon percents by weight as well as significant heats in the carbon range therebetween.

TABLE II

| BORON-FREE HEATS (Elements In Percents By Weight) | | | | | | |
|---|---|---|---|---|---|---|
| | | | | | B | |
| C | Mn | Si | S | Rc | 2 min | up to 25 min |
| 1.37 | 1.15 | 1.38 | 0.061 | 56.6 | 0.0 | 0.0 |
| 1.14 | 1.05 | 1.30 | 0.065 | 61.3 | 0.0 | 0.0 |
| 1.02 | 1.06 | 1.33 | — | 66.0 | 0.0 | 0.0 |
| 0.98 | 0.90 | 1.12 | — | 64.9 | 0.0 | 0.0 |
| 0.82 | 2.26 | 1.54 | 0.033 | 65.6 | 0.0 | 0.0 |
| 0.81 | 0.74 | 0.84 | 0.044 | 66.8 | 0.0 | 0.0 |

It should be emphasized that Table I represents the carbon extremes and selected intermediate boron containing heats for more than 60 heats which were actually poured under shot producing conditions. Likewise, Table II represents the carbon extremes and selected intermediate boron-free heats from many heats which were actually poured under shot producing conditions.

Standard industry life cycle tests indicated that shot produced from boron containing heats has a life at least equal to similar heats which are boron free. Moreover, no unique detrimental effects from the normal manufacturing parameters such as pouring time and water nozzle pressure were observed in the boron-bearing product, as compared to the boron-free product. Also, the percentage of hollows and miss-shapened shot particles was the same order of magnitude as for normal boron-free shot. Moreover, no coarseness of grain size occurred, as would have been predicted from the experience of metallurgists who have added boron for hardenability in plate steel production.

Thus, it can be seen that by the addition of boron, a yield of substantially fully martensitic structure is so assured despite carbon above the preferred range that the gas consuming hardening furnace and drying operations normally performed in the steel shot producing operation in order to comply with industry standards such as SFSA 20T-66 can, as a practical matter, be eliminated.

The process of making steel shot has been described previously as including the steps of: charging, melting, refining and pouring. FIG. 1 illustrates the equipment utilized in this procedure in schematic form. The numeral 10 designates an arc furnace or ladle containing molten steel. The numeral 12 designates a trough through which molten metal passes on its way to a tun dish or metering pot 14. The tun dish or metering pot 14 has a lower orifice 16 through which a metal stream 18 flows. A nozzle 20 directs a stream of fluid, usually water, under pressures of the order of magnitude of from 10 to 35 psi with the lower portion of the range preferable for the reason it permits a more direct path of the shot to the quenching bath and therefore a faster quench. The nozzle 20 creates a water stream 22 through which shot particles, indicated by the numeral 24, impinge and then drop into a water pit 26. The as-cast shot is then removed from the water pit 26 and taken directly to a tempering furnace or to a crushing operation when the principals of the instant invention are employed. When required, the boron is added to the steel near the end of the melting and refining procedure. The presence of the specified amounts of silicon insures that the heat is killed at this time.

A ferro-boron material having a nominal composition, for example of 18 percent boron and 82 percent iron and impurities may be dissolved in the molten metal just prior to tapping of the furnace or right after tapping of the furnace if it is performed in a ladle.

Having described the preferred embodiment, we wish to state that it is not our intention to be limited thereto, but to be limited rather only by the scope of the appended claims.

What is claimed is:

1. A method of producing cast steel shot having a microstructure of substantially all martensite tempered to a hardness in the range of from about 40 to 50 on the Rockwell C Scale which includes the steps of charging, melting, refining, pouring and tempering, said pouring step being performed by directing a stream of the melted and refined molten steel through a stream of fluid under pressure and into a fluid quenching bath to produce shot in an as-cast condition having a substantially fully martensitic structure and corresponding full hardness; and, said tempering step being performed on said shot while in its as-cast condition whereby an intermediate step of heat treating for hardening is eliminated.

2. The method of claim 1 in which said method includes the step of alloy-adding and said step includes the addition of ferro-boron to the melted metal.

3. The method of claim 1 in which said melted and refined steel comprises:

carbon in about the range of from 0.68 to 1.06 percent by weight; manganese in about the range of from 0.50 to 2.26 percent by weight; silicon in about the range of from 0.3 to 1.80 percent by weight; sulphur in about the range of from 0.0 to 0.1 percent by weight with the remainder substantially all iron and trace elements and impurities.

4. The method of claim 1 in which said melted and refined steel comprises:

carbon in about the range of from 0.6 to 1.20 percent by weight; manganese in about the range of from 0.50 to 2.26 percent by weight; silicon in about the range of from 0.3 to 1.80 percent by weight; sulphur in about the range of from 0.0 to 0.1 percent by weight; boron in about the range of from 0.0001 to 0.01 percent by weight, with the remainder substantially all iron and trace elements and impurities commonly found therein.

5. An as-cast steel shot having a substantially fully martensitic structure and corresponding full hardness which comprises: carbon in about the range of from 0.6 to 1.20 percent by weight; manganese in about the range of from 0.50 to 2.26 percent by weight; silicon in about the range of from 0.3 to 1.80 percent by weight; sulphur in about the range of from 0.0 to 0.1 percent by weight; boron in about the range of from 0.0001 to 0.01 percent by weight; with the remainder substantially all iron and trace elements and impurities commonly found therein.

6. A method of producing as-cast steel shot having a substantially fully martensitic structure and corresponding full hardness which includes the steps of charging, melting, refining, alloy-adding and pouring;

said pouring step being accomplished by directing a stream of the melted, refined and alloyed molten steel through a stream of fluid under pressure and into a fluid quenching bath; and said refined and alloyed steel comprising: carbon in about the range of from 0.6 to 1.20 percent by weight; manganese in about the range of from 0.50 to 2.26 percent by weight; silicon in about the range of from 0.3 to 1.80 percent by weight; sulphur in about the range of from 0.0 to 0.1 percent by weight; boron in about the range of from 0.0001 to 0.01 percent by weight, with the remainder substantially all iron and trace elements and impurities commonly found therein.

7. A method for producing steel grit having a substantially fully martensitic structure and corresponding full hardness which includes the steps of charging, melting, refining, pouring and crushing;

said pouring step being accomplished by directing a stream of the melted and refined molten steel through a stream of fluid under pressure and into a fluid quenching bath; and, said crushing step being performed on said shot while in its as-cast condition whereby an intermediate step of heat treating for hardening is eliminated.

8. The method of claim 7 in which said melted and refined steel comprises:

carbon in about the range of from 0.68 to 1.06 percent by weight; manganese in about the range of from 0.50 to 2.26 percent by weight; silicon in about the range of from 0.3 to 1.80 percent by weight; sulphur in about the range of from 0.0 to 0.1 percent by weight with the remainder substantially all iron and trace elements and impurities.

9. The method of claim 7 in which said melted and refined steel comprises:

carbon in about the range of from 0.6 to 1.20 percent by weight; manganese in about the range of from 0.50 to 2.26 percent by weight; silicon in about the range of from 0.3 to 1.80 percent by weight; sulphur in about the range of from 0.0 to 0.1 percent by weight; boron in about the range of from 0.0001 to 0.01 percent by weight, with the remainder substantially all iron and trace elements and impurities commonly found therein.

* * * * *

UNITED STATES PATENT OFFICE

CERTIFICATE OF CORRECTION

Patent No. 4,023,985 Dated May 17, 1977

Inventor(s) Fred J. Dunkerley, et al

It is certified that error appears in the above-identified patent and that said Letters Patent are hereby corrected as shown below:

Column 3, line 23 - change 0.003 to 0.0003

Column 4, Table T - change to read Table I

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*